US010274277B2

(12) United States Patent
Indruch

(10) Patent No.: US 10,274,277 B2
(45) Date of Patent: Apr. 30, 2019

(54) TRIGGER MECHANISM FOR AUTOMATIC AND SEMI-AUTOMATIC PISTOLS

(71) Applicant: CESKA ZBROJOVKA A.S., Uhersky Brod (CZ)

(72) Inventor: Jiri Indruch, Valasske Mezirici (CZ)

(73) Assignee: CESKA ZBROJOVKA A.S., Uhersky Brod (CZ)

( * ) Notice: Subject to any disclaimer, the term of this patent is extended or adjusted under 35 U.S.C. 154(b) by 0 days.

(21) Appl. No.: 15/767,603

(22) PCT Filed: Nov. 7, 2016

(86) PCT No.: PCT/CZ2016/000121

§ 371 (c)(1),
(2) Date: Apr. 11, 2018

(87) PCT Pub. No.: WO2017/080536

PCT Pub. Date: May 18, 2017

(65) Prior Publication Data

US 2018/0299221 A1 Oct. 18, 2018

(30) Foreign Application Priority Data

Nov. 11, 2015 (CZ) ..... 2015-805

(51) Int. Cl.
*F41A 19/10* (2006.01)
*F41A 19/30* (2006.01)

(52) U.S. Cl.
CPC ..... *F41A 19/10* (2013.01); *F41A 19/30* (2013.01)

(58) Field of Classification Search
CPC ..... F41A 19/10; F41A 19/12; F41A 19/16; F41A 19/17; F41A 19/25; F41A 19/27; F41A 19/29–19/32

(Continued)

(56) References Cited

U.S. PATENT DOCUMENTS 1,183,115 A * 5/1916 Reising ..... F41A 17/36 42/69.03
4,522,105 A * 6/1985 Atchisson ..... F41A 19/44 42/69.03

(Continued)

FOREIGN PATENT DOCUMENTS

EP 0751366 A1 1/1997
EP 2525185 A1 11/2012

OTHER PUBLICATIONS

International Search Report dated Jan. 17, 2017 in corresponding Application PCT/CZ2016/000121 (2 pages).

(Continued)

*Primary Examiner* — John Cooper
(74) *Attorney, Agent, or Firm* — Hovey Williams LLP

(57) ABSTRACT

The trigger mechanism for automatic and semi-automatic pistols contains a trigger lever (53), a trigger (50) connected to the trigger lever (53) and a container (302) for guiding a rear part of a breech (304). The trigger lever (53) is connected to the trigger (50) in a rotary way and comprises two arms (54, 55) having a space between them through which a magazine of the pistol passes and being connected with a cross rail (56) to which a vertical plate (57) is connected and which is provided on its top side with a top tooth (59) for tensioning a firing pin (1) and with a projection (49) for releasing the firing pin (1) block (46). The trigger (50), the vertical plate (57) and the firing pin (1) lie on a vertical plane of symmetry of the pistol and the arms (54, 55) are located symmetrically with respect to this plane.

6 Claims, 6 Drawing Sheets

(58) Field of Classification Search
USPC ..... 42/69.01–69.03
See application file for complete search history.

(56) References Cited

U.S. PATENT DOCUMENTS

| | | | | | |
|---|---|---|---|---|---|
| 4,589,327 | A * | 5/1986 | Smith | F41A 17/74 | 42/70.08 |
| 4,726,136 | A | 2/1988 | Dornaus et al. | | |
| 5,088,222 | A * | 2/1992 | Larson | F41A 17/56 | 42/70.04 |
| 5,216,195 | A * | 6/1993 | Tuma | F41A 17/82 | 42/69.03 |
| 5,400,537 | A * | 3/1995 | Meller | F41A 17/74 | 42/69.03 |
| 5,463,828 | A * | 11/1995 | Andrejevic | F41A 3/36 | 42/20 |
| 5,570,527 | A * | 11/1996 | Felicci | F41A 17/26 | 42/70.02 |
| 6,070,512 | A * | 6/2000 | Rohrbaugh | F41A 17/06 | 42/69.02 |
| 6,263,607 | B1 * | 7/2001 | Fuchs | F41A 17/36 | 42/70.01 |
| 6,588,136 | B2 * | 7/2003 | Baker | F41A 19/48 | 42/70.02 |
| 8,132,496 | B2 * | 3/2012 | Zukowski | F41A 17/66 | 42/70.01 |
| 2003/0070342 | A1 * | 4/2003 | Baker | F41A 19/48 | 42/69.03 |
| 2012/0180356 | A1 * | 7/2012 | Bender | F41A 19/14 | 42/69.01 |
| 2015/0211822 | A1 | 7/2015 | Hirschheiter | | |

OTHER PUBLICATIONS

Written Opinion of the International Searching Authority dated Jan. 17, 2017 in corresponding Application PCT/CZ2016/000121 (5 pages).

International Preliminary Report on Patentability in completed Feb. 14, 2018 in corresponding Application PCT/CZ2016/000121 (5 pages) with applicant's response dated Jan. 10, 2018 to the Written Opinion of the International Preliminary Examining Authority (5 pages) (10 pages total).

* cited by examiner

TRIGGER MECHANISM FOR AUTOMATIC AND SEMI-AUTOMATIC PISTOLS

RELATED APPLICATIONS

This application is the National Stage of International Patent Application No. PCT/CZ2016/000121, filed Nov. 7, 2016, which is hereby incorporated herein by reference in its entirety, and which claims priority to Czech Patent Application No. CZ 2015-805, filed Nov. 11, 2015, which is also incorporated herein by reference in its entirety.

FIELD OF THE INVENTION

The invention relates to a trigger mechanism for automatic and semi-automatic pistols.

BACKGROUND OF THE INVENTION

The document US 2015/0211822 describes a design of the trigger mechanism for automatic and semi-automatic pistols that uses a one-sided trigger lever with one tension spring. A disadvantage of this design consists in the fact that the control mechanism gets distorted at the end of the trigger lever due to one-sided pressure acting upon the trigger lever.

Trigger mechanisms that are known at present comprise containers that are used for guiding the rear part of the breech and for housing and control of the trigger lever. However, these well-known containers do not feature two spaces for insertion of springs and do not provide the possibility to control the functional surfaces of the trigger lever on one vertical plane comprising the longitudinal axis of the gun and the axis of the firing pin. Thus, asymmetrically acting forces are generated, increasing resistance friction, which impairs the reliability of the gun.

A part of the trigger mechanism is also the tripping pin of the trigger lever, which is used to lower the rear end of the trigger lever to disengage the tooth of the trigger lever from the tooth of the firing pin when the firing pin spring is fully tensioned. The prior-art structural designs do not enable arrangement of the functional surfaces on one vertical plane passing through the longitudinal axis of the gun and axis of the firing pin and in addition, in these designs the control edge is established in the bottom part of the breech, which increases production demands.

SUMMARY OF THE INVENTION

The above mentioned disadvantage of the prior art is eliminated by a design of the trigger mechanism for automatic and semi-automatic pistols comprising a trigger lever, a trigger connected to the trigger lever and a container for guiding the rear part of the breech the principle of which is that the trigger lever is connected to the trigger in a rotary way and comprises two arms, having a space between them that the magazine of the pistol passes through, connected with a cross rail that a vertical plate is connected to which features on its top side top tooth for tensioning the firing pin and a projection for releasing the firing pin block, wherein the trigger, vertical plate and firing pin lie on the vertical plane of symmetry of the pistol and the arms are located symmetrically with respect to this plane.

In one preferred embodiment, the vertical plate is fitted with a projection that gets in contact with the inclined surface of a recess during triggering to lower the position of the trigger lever during triggering so that the top tooth can get out of the engagement with the tooth on the firing pin when the firing pin spring is fully tensioned, wherein the projection, recess, top tooth and tooth lie on the vertical plane of symmetry of the pistol.

In another preferred embodiment, the trigger mechanism contains a pair of springs that act against the pressure of the striking spring of the firing pin and with their first ends they are fixed to the cross rail and with their other ends to a shaft installed in a gate created in the vertical plate, the springs being positioned symmetrically with respect to the said vertical plane of symmetry of the pistol.

In yet another preferred embodiment the container includes the right and left part connected to each other with a bridge, thus creating the shape of the letter U.

In another preferred embodiment, the container is fixed in the pistol frame and on its right and left part it is fitted with guide rails for guiding the breech and with openings in which the shaft ends are mounted, wherein the said bridge contains an opening where the tripping pin is installed.

In another preferred embodiment, the tripping pin has a rectangular shape passing at one end of the tripping pin into a radius end ensuring its lateral movement by the action of a shaped recess created on the bottom guide rail of the breech in such a way that when the breech moves to the rear position, the edge of this recess presses onto the radius end, pushes it to the side and this radius end further slides along the breech edge, during the return movement the radius end fits into the shaped recess in the guide rail of the breech and moves the tripping pin of the trigger lever into the original position. At the other end of the tripping pin there is preferably an opening where a return spring is mounted.

BRIEF DESCRIPTION OF THE DRAWINGS

The invention will be clarified in a more detailed way using an example of its embodiment with reference to drawings where.

DETAILED DESCRIPTION OF EMBODIMENTS

Figure 1:
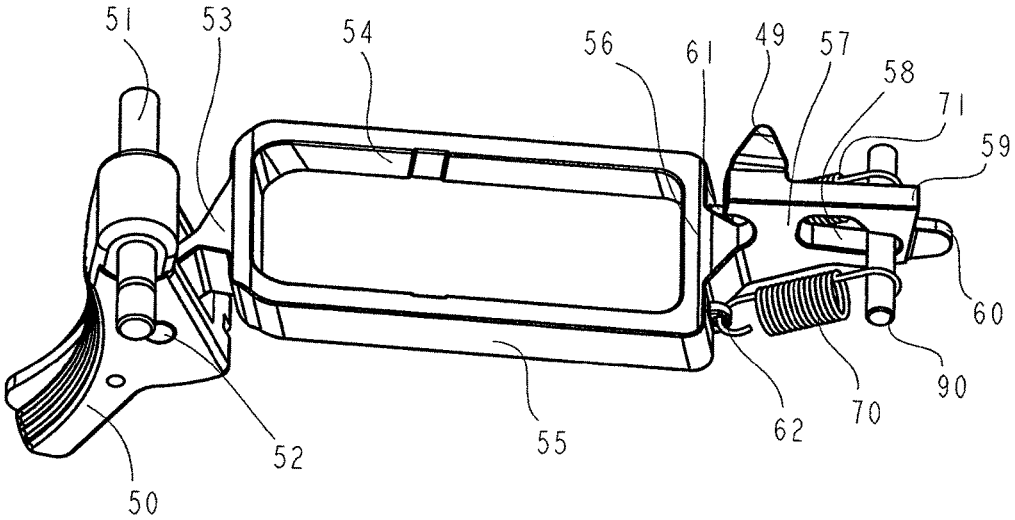
FIG. 1 shows an embodiment example of the trigger lever and trigger that are part of the trigger mechanism according to the invention.
Figure 6:
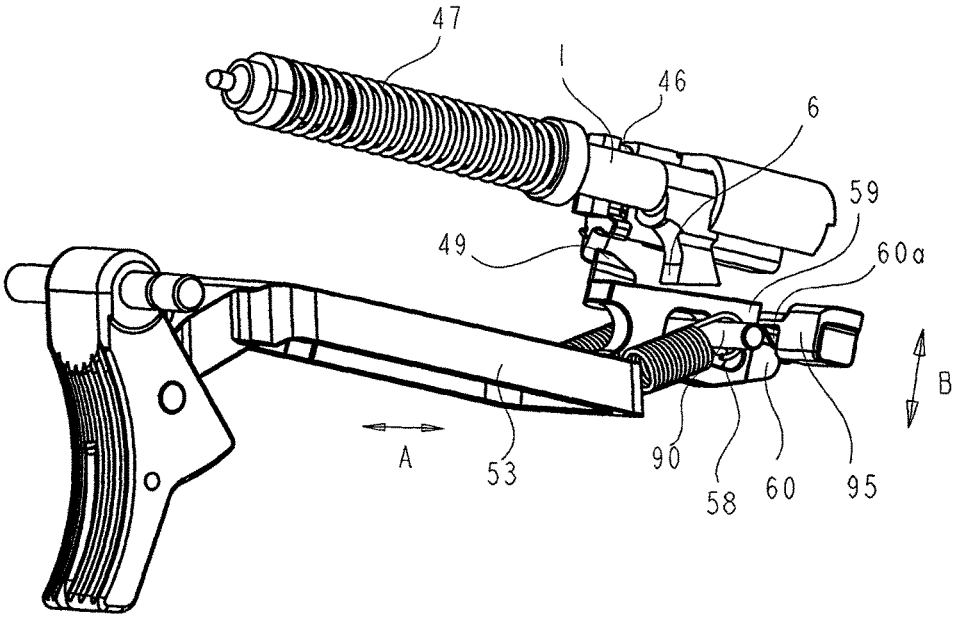
FIG. 6 shows a perspective view of the trigger mechanism from FIG. 5 in the position where the firing pin has been released.

FIG. 1 shows an example of an arrangement of the trigger lever 53 that is part of the trigger mechanism of the invention. In the design of the trigger mechanism according to the invention, the contact surfaces of the trigger mechanism fulfil their function on one vertical plane comprising the axis of the firing pin 1 (the firing pin 1 is not part of the trigger mechanism and is shown in FIG. 6). This arrangement further provides sufficient space for the use of two springs 70 and 71 that act against the pressure of the striking spring 47 (FIG. 6), which makes it possible to achieve a bigger range of resistance of the trigger 50 during triggering.

Figure 5:
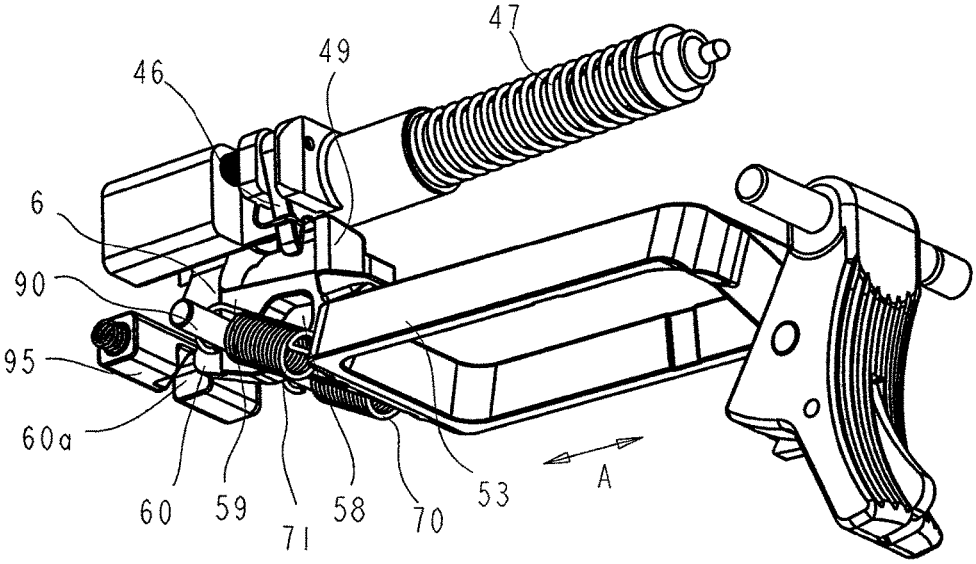
FIG. 5 shows a perspective view of the trigger mechanism according to the invention from FIGS. 1 to 4 in the position where the firing pin is locked.

As shown in FIG. 1, the trigger mechanism contains a trigger 50 in which a trigger lever 53 is mounted in a rotary way and along a longitudinal axis of the gun, which branches into two arms 54 and 55 providing a channel for the magazine, which is not shown here, inside itself (the magazine is not part of the trigger mechanism). This branching is terminated with a cross rail 56 on which a vertical plate 57 is formed along the longitudinal axis, the plate having at its end the top tooth 59 used for tensioning of the firing pin 1, as clearly shown in FIG. 5, and under it a projection 60 terminated with a radius that, during triggering, hits the inclined surface of the trip of the trigger lever 53 that consists of a recess 60*a* (also see FIG. 5). On the lateral side of the vertical plate 57 there is a projection 49 for releasing the block 46 of the firing pin 1 as a consequence of pulling the trigger 50 and thus the movement of the trigger lever 53 rearwards (i.e. against the firing direction). This releasing is done in such a way that due to pressing of the trigger 50 the trigger lever 53 moves backwards and the projection 49 deflects the block 46 of the firing pin 1. In the plate 57, a gate 58 is further created. On the cross rail 56 there are two holders 61 and 62 for the springs 71 and 70. In the rear part, the trigger lever 53 is guided by means of two or four opposite projections 161 and 162 (see FIG. 2) that prevent lateral movement of the trigger lever 53 and make sure it is guided along a direct axis. These protrusions 161 and 162 are in a direct contact with the side walls of the plate 57 of the trigger lever 53. This guiding guarantees a minimal resistance. The vertical movement of the trigger lever is restricted by the shape of the gate 58 which the shaft 90 passes through, being situated at the angle of 90° with respect to the longitudinal direction of the trigger lever 53.

The trigger 50 is mounted on a pivot 51 (see FIG. 1) perpendicular to the longitudinal direction of the gun with which direction also axis of the breech 304 and axis of the firing pin 1 and of striker are parallel. In the central part of the trigger 50, the trigger lever 53, branching into two arms 54 and 55, is mounted on a pin 52 perpendicular to the said longitudinal direction of the gun. On the cross rail 56, on both sides of the vertical plate 57, holders 61 and 62 are created for attachment of one side of the springs 70 and 71. The other side of the springs 70, 71 is fixed to the shaft 90.

Figure 2:
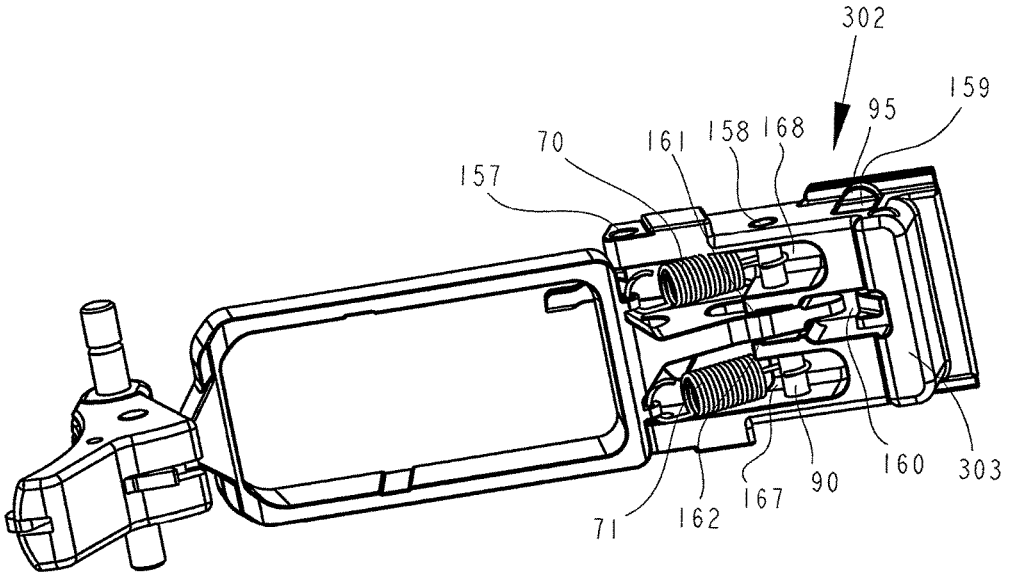
FIG. 2 shows a perspective view from the bottom of the trigger lever and trigger from FIG. 1 and the container for guiding the rear part of the breech and for housing and control of the trigger lever.
Figure 3:
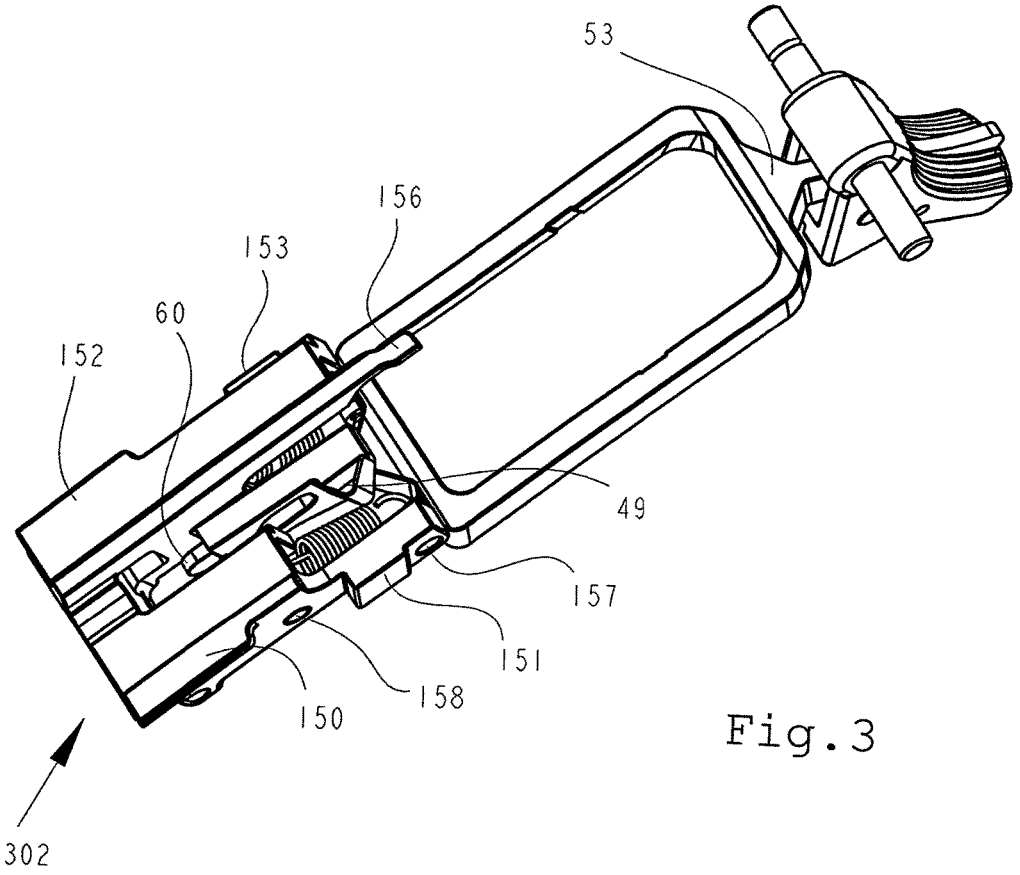
FIG. 3 shows a perspective view from the top of the trigger mechanism from FIG. 2.

FIGS. 2 and 3 show another part of the trigger mechanism—container, which serves for guiding the rear part of the breech 304 and for housing and control of the trigger lever 53. The design of the container uses the right and left guide rail 150 and 152. In the container, the trigger lever 53 is guided and two spaces 167 and 168 are created in it for insertion of the springs 71 and 70 and it further contains a transversal channel for mounting of the tripping pin 95 (see FIG. 2) of the trigger lever 53. On the container, a cartridge case ejector 156 is further created.

The design of the container according to the present invention makes sure that the trigger lever 53 is guided in one direction identical to the longitudinal direction of the gun and to the direction of the axis of the firing pin 1 and also that the functional surfaces of the trigger lever 53 work in the same direction. Further, this design enables the use of two springs 70 and 71 for the function of the trigger lever 53.

Figure 4:
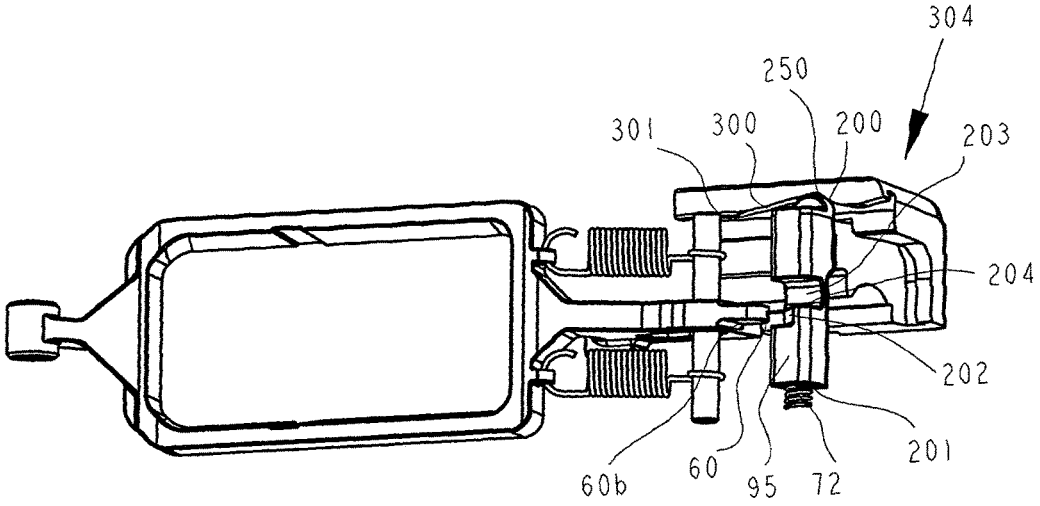
FIG. 4 shows a detail of the tripping pin of the trigger mechanism from FIGS. 1 to 3.

As shown in FIGS. 2 and 3, the container 302 consists of the right and left part connected together with a bridge 303, forming the shape of the letter U. At the right side of the container 302, a guide rail 150 is provided for guiding of the breech 304, which is not part of the trigger mechanism, as well as a protrusion 151 used to fix the container 302 inside the frame of the gun. For the reasons of clarity, the part of the breech 304 is shown in FIG. 4 without the container 302. On the left side of the container 302, there is a guide rail 152 of the breech 304 and a protrusion 153 used to fix the container 302 in the gun frame. In addition, the container 302 is equipped with an ejector 156 at the left side. In the front part of the container 302, an opening 157 is provided perpendicularly to the container 302 axis, passing through the left as well as right side, ensuring fixation of the container 302 in the gun frame. Approximately in the middle of the container 302 another opening 158 is provided that passes through the left and right part, used for the mounting of the shaft 90 (shown in FIG. 1). In the rear part of the container 302, in the place of connection of the right and left part with the bridge 303, an opening 159 is provided all along the length of the bridge 303, perpendicularly to the longitudinal axis of the container that is used for guiding of the tripping pin 95. This opening 159 is fitted with a recess 160 that is arranged perpendicularly to the axis of the opening 159 and is used to make the projection 60 of the trigger lever 53 accessible for the control surfaces of the tripping pin 95. In front of the recess 160 a free space is provided on the container 302 axis that the projections 161, 162 reach into, preventing lateral movement of the trigger lever 53 and ensuring its guiding along the direct axis. In the container 302, a space 167 is provided for guiding the spring 71 and a space 168 for guiding the spring 70.

As shown in FIGS. 2, 4, 5 and 6, the trigger mechanism also comprises the tripping pin 95 of the trigger lever 53 that is used to lower the rear end of the trigger lever 53 in the direction B shown in FIG. 6, disengaging the top tooth 59 of the trigger lever 53 from the tooth 6 of the firing pin 1 when the firing pin spring 47 is fully tensioned. The said tripping is controlled by the inclined surface 202, which may be produced at various angles to alter the operation and resistance during triggering. This tripping pin 95 of the trigger lever 53 is mounted perpendicularly to the axis of the trigger lever 53 and its control is implemented by means of a shaped recess 300 provided on the guide rail 301 of the breech 304.

As shown in FIGS. 2 to 4, the tripping pin 95 of the trigger lever 53 has a rectangular shape that prevents its position from rotating. At one side, its rectangular shape passes into a radius end 200 ensuring its lateral movement by the action of the pressure of the guide rail 301 of the breech 304 in such a way that when the breech 304 moves to the rear position, the shaped recess 300 of the guide rail 301 of the breech 304 presses onto the radius end 200, which leaves the recess 250 of the breech 304, and pushes it to the side and this radius end 200 further slides along the guide rail 301 of the breech 304, during the return movement of the breech 304 the radius end 200 fits into the recess 250 in the guide rail 301 of the breech 304 and moves the tripping pin 95 of the trigger lever 53 into the original position. At the other side of the tripping pin 95 of the trigger lever 53 there is an opening 201 where a return spring 72 is mounted (see FIG. 4). Approximately in the middle of the tripping pin 95 of the trigger lever 53, an inclined surface 202 is created, the projection 60 of the trigger lever 53 getting in contact with this inclined surface. Next to this inclined surface 202, towards the radius end 200, a channel 203 is created, enabling vertical movement of the trigger lever 53 and its projection 60.

Now, the function of the trigger mechanism will be summarized as ensuing from the above mentioned description in combination with the figures. Before pressing of the trigger 50, the trigger mechanism is in the state shown in FIG. 5. In this state, the tooth 59 of the trigger lever 53 holds the tooth 6 of the firing pin 1 (the tooth 6 is also well visible in FIG. 6). On pressing of the trigger 50 the trigger lever 53 gets shifted and its tooth 59, which pushes the tooth 6 of the firing pin 1, causes tensioning of the striking spring 47 of the firing pin 1. This movement is also supported by the tension springs 70 and 71, which are tensioned before the pressing of the trigger and during triggering they help overcome the resistance of the striking spring 47. In the final stage of the movement of the trigger lever 53, the projection 49 of the trigger lever 53 hits the block 46, deflecting it in such a way as not to block the forward movement of the firing pin 1, and at the same time the projection 60 of the trigger lever 53 hits the inclined surface 202 (shown schematically in FIG. 2) of the tripping pin 95. This causes lowering of the trigger lever 53 and its tooth 59, which leaves the tooth 6 of the firing pin 1, releasing the firing pin 1.

After firing of the cartridge, the breech 304 moves to the rear position of the gun. During this movement of the breech 304, the tripping pin 95 is compressed in such a way that the guide rail 301 of the breech 304 hits its radius end 200 (see FIG. 4), which is found in the shaped recess 250 of the breech 304 just before the shot, which causes lateral compression of the spring-loaded tripping pin 95. This causes releasing of the trigger lever 53 from the inclined surface 202 of the tripping pin 95. The trigger lever 53 is held by the tension springs 70 and 71 in the rear position and it is returned to its position when during the return movement of the breech 304 its tooth 59 is caught by the tooth 6 of the firing pin 1, which results in tensioning of the striking spring 47 of the firing pin 1. The striking spring 47 of the firing pin 1 acts against the force of the tension springs 70 and 71 and after releasing of the pressure onto the trigger 50 it returns the trigger lever 53 to its front position and at the same time tensions the tension spring 70 and 71—see the initial state in FIG. 5. When the pressure acting upon the trigger 50 is released, the tripping pin 95 returns to its original position. Before the release of the trigger 50 the tripping pin 95 leaned with its surface 204 (shown in FIG. 4) against the surface 60*b* of the projection 60 of the trigger lever 53.

The present invention is not limited to the embodiment example described and shown above, but it also comprises all modifications and changes falling within the frame delimited by the attached patent claims.

LIST OF REFERENCE MARKS

1—firing pin
6—tooth
46—lock
47—spring
49—projection
50—trigger
51, 52—pivot
53—trigger lever
54, 55—arm
56—rail
57—plate
58—gate
59—tooth
60—projection
60*a*—recess
60*b*—surface
61, 62—holder
70, 71, 72—spring
90—shaft
95—tripping pin
150—guide rail
151—protrusion
152—guide rail
153—protrusion
156—cartridge case ejector
157, 158, 159—opening
160—recess
161, 162—projection
167, 168—space
200—radius end
201—opening
202—surface
203—channel
204—surface
250—recess
300—shaped recess
301—guide rail of the breech
302—container
303—bridge
304—breech
A, B—direction

The invention claimed is:

1. A trigger mechanism for automatic and semi-automatic pistols comprising a trigger lever, a trigger connected to the trigger lever, a vertical plate and a container for guiding a rear part of a breech, wherein the trigger lever is connected to the trigger in a rotary way and comprises two arms having a space between the two arms for passing of a magazine and the two arms being connected with a cross rail to which said vertical plate is connected and which is provided on the vertical plate top side with a top tooth for tensioning a firing pin and with a projection for releasing a firing pin block, wherein the trigger, the vertical plate and the firing pin are adapted to lie on a vertical plane of symmetry of a pistol and the two arms are located symmetrically with respect to the vertical plane, wherein the trigger mechanism contains a pair of springs configured to exert force against pressure of a striking spring of the firing pin and the pair of springs are fixed with their first ends to the cross rail and with their other ends to a shaft installed in a gate created in the vertical plate, the pair of springs being positioned symmetrically with respect to the vertical plane of the pistol.

2. The trigger mechanism according to claim 1, wherein the vertical plate is fitted with a projection designed to hit an inclined surface of a recess during a triggering to lower the position of the trigger lever during the triggering to get the top tooth out of an engagement with a tooth on the firing pin while the striking spring of the firing pin is fully tensioned, wherein the protrusion, the recess, the top tooth and the tooth on the firing pin lie on the vertical plane of the pistol.

3. The trigger mechanism according to claim 1, wherein the container includes a right part and a left part connected to each other with a bridge, thus forming the shape of the letter U.

4. The trigger mechanism according to claim 3, wherein the container is fixable in a pistol frame and the right part and the left part are fitted with guide rails for guiding the breech and with openings in which the shaft ends are mounted, and wherein the trigger mechanism further comprises a tripping pin wherein the bridge contains an opening in which the tripping pin is installed.

5. The trigger mechanism according to claim 4, wherein the tripping pin has a rectangular shape, passing, at one end of the tripping pin, into a radius end leaning against a recess of a shaped recess created in a guide rail (301) of the breech, for lateral movement of the tripping pin during the movement of the breech to the rear position after a shot and for the return lateral movement of the tripping pin during the reverse-forward movement of the breech, ended by fitting of the radius end into the recess in the guide rail of the breech, thus bringing the tripping pin of the trigger lever into the original position before the shot.

6. The trigger mechanism according to claim 5, wherein the tripping pin is fitted with an opening for mounting of a return spring at an end opposite the radius end.

* * * * *